United States Patent [19]

Gerritsen

[11] 4,305,230

[45] Dec. 15, 1981

[54] SEALING RETAINER

[75] Inventor: John T. Gerritsen, Hanover Park, Ill.

[73] Assignee: Jarrow Products, Inc., Chicago, Ill.

[21] Appl. No.: 105,193

[22] Filed: Dec. 19, 1979

[51] Int. Cl.[3] ..... E06B 7/16

[52] U.S. Cl. ..... 49/487; 49/478

[58] Field of Search ..... 49/486, 487, 484, 478, 49/489, 495; 52/309.7, 309.9, 309.11, 809, 828

[56] References Cited

U.S. PATENT DOCUMENTS

| | | | |
|---|---|---|---|
| 3,289,352 | 12/1966 | Heilweil et al. | 49/478 X |
| 3,378,958 | 4/1968 | Parks et al. | 49/495 X |
| 4,119,325 | 10/1978 | Oakley et al. | 49/492 X |

*Primary Examiner*—Kenneth Downey

*Attorney, Agent, or Firm*—Silverman, Cass & Singer, Ltd.

[57] ABSTRACT

A retainer for use in a refrigerator door or the like in which insulative material is foamed during a foaming process in the interior of the door. The door or the like is formed of separate shell and pan portions which have edges which are inserted in respective opposing slots of the retainer. Fins are provided on surfaces of the retainer opposite the shell and pan portion edges to form a seal therewith which retains the insulative material within the interior of the door during the foaming process. The fins are made of a material which is softer and more flexible than the material of the remainder of the retainer and the fins eliminate a need to clean foamed insulative material which leaks through the seams between the retainer and the shell and pan portions during the foaming process from the exterior surfaces of the shell and pan portions.

6 Claims, 4 Drawing Figures

SEALING RETAINER

BACKGROUND OF THE INVENTION

This invention relates to refrigerator doors, wall panels, ceiling and floor units and the like which are constructed with insulative material foamed in their interiors and in particular is concerned with a retainer used in such doors and the like which seals the insulative material in their interiors during the foaming process.

A door for use in equipment such as refrigerators is manufactured by assembling together separate shell and pan portions with a retainer to form a hollow interior in which the insulative material is located. Various types of insulative materials have been used, foamed plastic such as polyurethane having become popular. In many instances the foamed plastic which has adhesive properties is used in place of mechanical fasteners to hold the shell, pan and retainer together in the finished door. A door of this type is known in the trade as being of the foamed-in variety.

The manufacture of a door of the foamed-in variety involves inserting respective edge portions of the shell and pan into opposed slots of the retainer in a fixture. The foamable insulative material then is loaded into the enclosure so formed and heat is applied to expand the foamable material into the otherwise hollow enclosure. During the foaming process, the fixture maintains the positions of the shell, pan and retainer relative to each other and resists the pressure exerted by the foaming material on the shell and pan which would otherwise distort the shape of the finished door. An example of such a door is the door disclosed in U.S. Pat. No. 3,226,367 to Monti which disclosed a gasket and retainer assembly for such a door.

A problem with the door of the foamed-in variety is that the insulative material leaks out of the interior of the door onto the exterior surfaces of the shell and pan during the foaming process, requiring a hand cleaning step of the door after the door has been formed. This leakage occurs at the seams between the retainer and the shell and pan and results from the retainer being made of a hard inflexible material which does not easily conform to the irregular surfaces of the shell and pan. It is, therefore, often impossible to obtain a positive seal between the retainer and shell and pan. This problem of leakage is aggravated when the surfaces of the shell and pan are embossed or textured as is popular today.

SUMMARY OF THE INVENTION

In accordance with the invention, fins are provided which are located on a retainer opposite surfaces of a shell and pan of a foamed-in variety refrigerator and the like door, said fins being formed of a material which is more flexible than the material of the remainder of the retainer. The fins will conform to the surfaces of the shell and pan and are effective under the pressure exerted by expanding foam insulative material to form a seal between the retainer, shell and pan which retains the expanding foam material within the enclosure of the retainer, shell and pan.

DESCRIPTION OF THE PREFERRED EMBODIMENT

Figure 1:
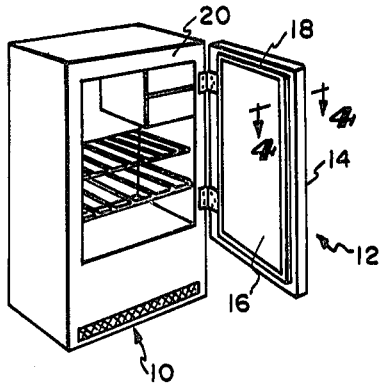
FIG. 1 is a perspective view of a refrigerator having its door open, showing a gasket and retainer assembly installed in the door which retainer may include the fins of the invention.

Referring to the FIG. 1, there is shown a refrigerator 10 which includes a door 12 of the so-called foamed-in variety. Door 12 has an outer shell portion 14 and an inner pan portion 16. A gasket and retainer assembly 18 is located at the seam between shell and pan portions 14 and 16 around the circumference of the interior of door 12. As commonly known, gasket and retainer assembly 18 forms a tight seal with the metal front framing plate 20 of refrigerator 10 to preserve the temperature gradient between the refrigerator and/or freezer compartment on the one hand and the ambient air on the other hand.

Figure 2:
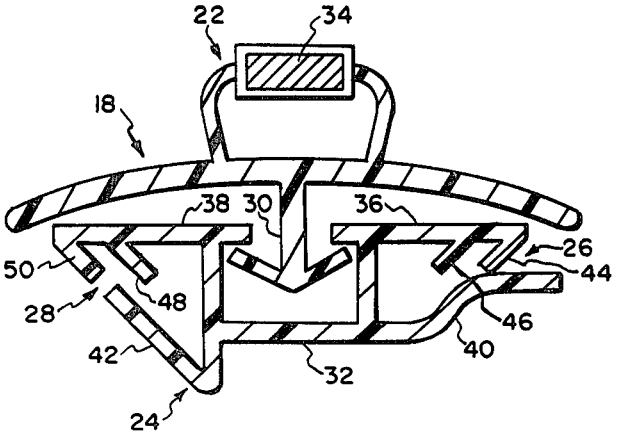
FIG. 2 is a transverse sectional view through a gasket and retainer assembly in which the retainer includes the fins of the invention.
Figure 4:
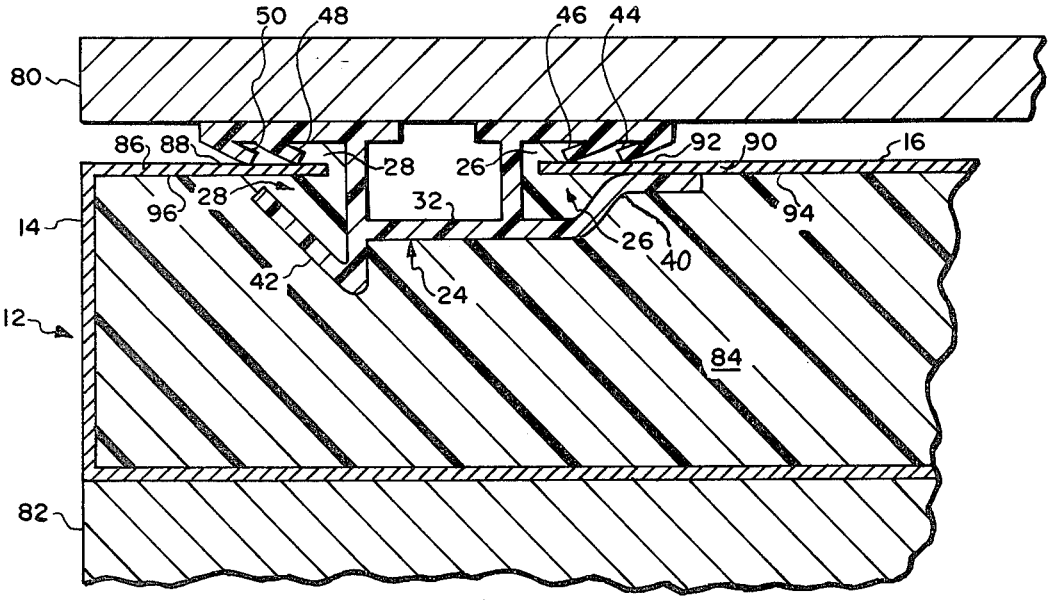
FIG. 4 is a fragmentary sectional view of the door of FIG. 1 taken generally along line 4—4 in the direction of the arrows which includes the retainer of FIG. 2 and which is shown in a fixture in which the foaming process occurs.

FIG. 2 shows the gasket and retainer assembly 18, including a gasket 22 and a retainer 24. Gasket and retainer assembly 18 is assembled in door 12 with an edge portion of pan 16 inserted into slot 26 and an edge portion of shell 14 inserted in slot 28, as illustrated in FIG. 4.

Gasket 22 is coupled to retainer 24 by an arrow-like head formation 30 extending into a rectangular body portion 32 of retainer 24. Gasket 22 normally includes a magnetic strip 34 molded or carried in the body of the retainer, said strip being magnetically attracted to the front framing plate 20 of refrigerator 10 to carry the gasket body tightly against the plate 20 and thereby to form a seal therewith.

Retainer 24 includes essentially co-plannar flanges 36 and 38 extending from the top of rectangular body portion 32 and two arms 40 and 42 connected to the lower portion of rectangular body portion 32. Flanges 36 and 38 include fins 44 and 46, and 48 and 50 which respectively point or are directed toward the rectangular body portion 32 in slots 26 and 28.

Figure 3:
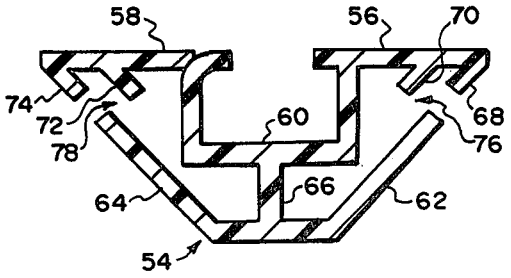
FIG. 3 is a transverse sectional view through another retainer which has a cross-section different from the retainer of FIG. 2 and which also includes the fins of the invention.

FIG. 3 illustrates a retainer 54 having flanges 56 and 58 connected to the upper portion of rectangular body portion 60 and two arms 62 and 64 connected to the bottom of rectangular body portion 60 by connecting member 66. Top flanges 56 and 58 include fins 68 and 70, and 72 and 74, which are respectively directed toward rectangular body portion 60 in slots 76 and 78.

FIG. 4 illustrates a fragmentary cross section of the door 12 of FIG. 1 held between plates 80 and 82 of the fixture in which door is formed. The door 12 includes the retainer 24 of FIG. 2 and is shown in an interim manufacturing state before gasket 22 is assembled with the retainer.

The door 12 includes shell and pan portions 14 and 16, retainer 24 and insulative material such as polyurethane foam 84 foamed in the interior of the door. Shell 14 includes an edge portion 86 extending into slot 28 with edge 86 including an exterior surface 88 in contact with fins 48 and 50. Pan 16 includes an edge portion 90 extending into slot 26 with edge portion 90 including an exterior surface 92 in contact with fins 44 and 46 and an interior surface 94 in contact with arm 40.

Retainer 24 usually is made of a relatively hard plastic material while shell 14 and pan 16 usually are made of metal and often have irregular surface configurations. The durometer of the hard plastic material of retainer 24 is in the range of 70±5 Shore(D).

During the foaming process, the expansion of insulative material 84 exerts a pressure against interior surface 96 of shell 14. This pressure presses the edge portion 86 tight against fins 48 and 50 which conform to any possible irregularities of exterior surface 88 to form a positive seal therewith which retains the polyurethane foam 84 within the interior of door 12. The seal is enhanced by the pressure exerted by this expanding foam 84 bearing directly against the fins 48 and 50 in slot 28 and pressing the fins against the exterior surface 88 of shell 14. Fins 48 and 50 are made of a material which is softer and more flexible than the remainder of retainer 44 and, as such, readily conform to any irregularities, embossing or texturing of the exterior surface 88 with which they form a positive seal, preventing the polyurethane foam from leaking out past the retainer 24 onto exterior surface 88. By techniques which are known. The retainer 24 with the integral fins 44, 46, 48 and 50 is extruded in one pass through a die. The fins can be of a durometer in the range of 65±5 Shore(A). This being considerably different from the range of durometer of the remainder of the retainer 24.

During the foaming process, plates 80 and 82 exert a pressure against retainer 24, shell 14 and pan 16, which resist the pressure of expanding polyurethane foam 84 and maintains the door 12 in the desired shape. Arm 42 does not press against or contact edge portion 86 of shell 14 which allows polyurethane foam 84 to enter slot 28 so that when the polyurethane foam solidifies, retainer 24 is positively held in the door by a volume of the solidified insulative material.

Even though edge portion 90 of pan 16 is shown clamped between arm 40 and fins 44 and 46, polyurethane foam 84 may readily flow into slot 26 between arm 40 and interior surface 94. The polyurethane foam 84 in slot 26 is retained therein by fins 44 and 46, which, like fins 48 and 50, are made of a soft flexible material which conforms to the exterior surface 92 of pan 16 to form a positive seal therewith and prevent the polyurethane foam from leaking out onto the exterior surface 92 of pan 16.

It will be appreciated that retainer 54 may be substituted for retainer 24 in which case exterior surfaces 88 and 92, respectively, will be pressed against fins 72 and 74 and fins 68 and 70 to form a positive seal therewith and retain polyurethane foam 84 within the interior of door 12 as has been described with fins 48 and 50 in retainer 24. When retainer 54 is used in place of retainer 24, polyurethane foam 84 will be able to enter both slots 76 and 78 and when solidified will hold retainer 54 in door 12.

The retainers 24 and 54 are extruded by so-called multi-durometer techniques in which an integral shape has different parts of its cross section of substantially different durometer, this difference being uniform along the length of the extrusion. Preferred materials for the retainers of the invention are plastic and rubber type materials, as for example so-called rigid PVC's, TPE's (thermoplastic elastomers), and TPR's thermoplastic rubbers).

Modifications and variations of the present invention are possible in light of the hereinabove teachings. These include modifying and varying the number, shape and location of the fins and the direction in which the fins are disposed. It is, therefore, to be understood that within the scope of the appended claims, the invention may be practiced otherwise than specifically described.

What is claimed and is desired to be secured by Letters Patent of the United States is:

1. A retainer for use in assembling a refrigerator door and the like wherein the door is adapted to have foamed insulative material formed in situ on the interior of the door, the door being constructed in a manner which includes an exterior shell and an interior pan, the retainer being arranged to couple the shell and pan together, the retainer having opposed interior slots and the shell having an interior facing edge adapted to be engaged in one of the slots while the pan having an exterior edge adapted to be engaged in the other of the slots, said retainer comprising:

a. An elongate extruded member of uniform cross section and having pairs of flanges extending in opposite directions, each pair being spaced apart to provide a slot therebetween whereby there are two slots opening in opposite directions;

b. Each flange pair having juxtaposed spaced apart surfaces comprising said slots, the pan and shell of the refrigerator door adapted to be respectively inserted in oppositely opening slots to generally form and combine the insulative material chamber on the interior of the door when so assembled;

c. Said retainer having flexible fins formed on at least one of said spaced apart surfaces of each slot and extending across said slot whereby said fins will be engaged by the pan and shell as the said edges are inserted into the respective slots to enable the formation of a seal for preventing leaking of the foam insulative material between the flexible fins and the pan and shell when the foaming operation is carried out.

2. The retainer as claimed in claim 1 in which the retainer including said flanges is substantially more rigid than the fins and the fins are sufficiently resilient to yield but remain engaged against the pan and shell edges when the latter are inserted into said slots.

3. The retainer as claimed in claim 1 in which the fins are integral with the said spaced apart surfaces of those of the flanges of the pairs which are adapted to be outward of the door interior.

4. The retainer as claimed in claim 1 in which the fins slant inward of said respective slots whereby the slant is increased when said pan and shell edges are inserted and will be forced against said pan and shell by any insulative material forced out of the slots.

5. The retainer as claimed in claim 2 in which the fins slant inward of said respective slots whereby the slant is increased when said pan and shell edges are inserted and will be forced against said pan and shell by any insulative material forced out of the slots.

6. The retainer as claimed in claim 3 in which the fins slant inward of said respective slots whereby the slant is increased when said pan and shell edges are inserted and will be forced against said pan and shell by any insulative material forced out of the slots.

* * * * *